US008105665B2

(12) United States Patent
Kaimoto

(10) Patent No.: US 8,105,665 B2
(45) Date of Patent: Jan. 31, 2012

(54) INK-JET RECORDING MEDIUM AND RECORDING METHOD

(75) Inventor: Hideki Kaimoto, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 310 days.

(21) Appl. No.: 12/410,942

(22) Filed: Mar. 25, 2009

(65) Prior Publication Data

US 2009/0246380 A1 Oct. 1, 2009

(30) Foreign Application Priority Data

Mar. 31, 2008 (JP) ..... 2008-090996

(51) Int. Cl.
*B41M 5/40* (2006.01)

(52) U.S. Cl. ..... 428/32.21; 428/32.22; 428/32.28; 428/32.34

(58) Field of Classification Search ..... 428/32.21, 428/32.22, 32.28, 32.34
See application file for complete search history.

(56) References Cited

U.S. PATENT DOCUMENTS

| | | | | |
|---|---|---|---|---|
| 6,165,606 | A | 12/2000 | Kasahara | |
| 2002/0182380 | A1 * | 12/2002 | Nagashima et al. | 428/195 |
| 2003/0211293 | A1 * | 11/2003 | Nemoto et al. | 428/195 |
| 2007/0054070 | A1 * | 3/2007 | Laney et al. | 428/32.34 |

FOREIGN PATENT DOCUMENTS

| | | | |
|---|---|---|---|
| JP | 9-234944 | A | 9/1997 |
| JP | 10-217601 | A | 8/1998 |

* cited by examiner

*Primary Examiner* — Betelhem Shewareged
(74) *Attorney, Agent, or Firm* — Sughrue Mion, PLLC

(57) ABSTRACT

An ink-jet recording medium having a non-absorbent support; an ink-receiving layer containing an inorganic pigment and a binder, disposed on one surface of the non-absorbent support; and a water-absorbent layer containing a water-absorbent polymer and a pigment, disposed on the other surface of the non-absorbent support, opposite to the one surface provided with the ink-receiving layer.

8 Claims, No Drawings

INK-JET RECORDING MEDIUM AND RECORDING METHOD

CROSS-REFERENCE TO RELATED APPLICATION

This application is based on and claims priority under 35 USC 119 from Japanese patent Application No. 2008-090996 filed on Mar. 31, 2008, the disclosure of which is incorporated by reference in its entirety.

BACKGROUND OF THE INVENTION

1. Field of the Invention

The present invention relates to an ink-jet recording medium and a recording method using the same.

2. Description of the Related Art

In recent years, with the rapid development of information industry, various information-processing systems, and further recording methods and devices suitable for the systems have been developed and put into practical use respectively. Among such recording methods, an ink-jet recording method is advantageous in that the method is capable of recording on various recording materials and that a hardware (apparatus) used in the method is relatively inexpensive, compact, and quiet. Therefore, the ink-jet recording method has been widely used in so-called home use as well as in offices.

Furthermore, in recent years, with the resolution increase of ink-jet printer and the development of hardware (apparatus), various ink-jet recording media have been developed (see, for example, JP-A Nos. 9-234944 and 10-217601).

However, in ink-jet systems using aqueous dye inks, the hue of a printed ink greatly changes after printing and it takes a long time to stabilize the hue. Further, when a plurality of printed media are stacked before sufficiently dried, the hue becomes different from the desired one.

SUMMARY OF THE INVENTION

Particularly, in the case of using an ink-jet recording medium containing a non-water-absorbent support in an ink-jet system, the support cannot absorb water in a printed ink. The hue of the printed ink changes due to water evaporation from the surface of the medium, and thus the resultant hue is different from the desired one disadvantageously. It has been difficult to solve the problem.

The present invention provides an ink-jet recording medium capable of reducing the change of a printed image hue.

The inventors have found that, by using an ink-jet recording medium with a water-absorbent back surface, in a stack of printed media (printed materials), the back surface can absorb water in an ink printed on the lower adjacent medium to reduce the hue change. The inventors have further found that, by subjecting the stack of printed media to a pressure treatment, the hue change can be reduced more effectively. The invention has been accomplished based on the findings.

According to a first aspect of the invention, there is provided an ink-jet recording medium comprising a non-absorbent support; an ink-receiving layer containing an inorganic pigment and a binder, disposed on one surface of the non-absorbent support; and a water-absorbent layer containing a water-absorbent polymer and a pigment, disposed on the other surface of the non-absorbent support, opposite to the one surface provided with the ink-receiving layer.

According to a second aspect of the invention, there is provided a recording method comprising subjecting a stack of a plurality of the above ink-jet recording media to a pressure treatment after printing.

In the invention, the hue change of an image on the ink-jet recording medium can be reduced after printing.

DETAILED DESCRIPTION OF THE INVENTION

In the present invention, a water-absorbent polymer (particularly a polymer capable of absorbing water and a solvent in an ink) and a pigment are disposed on the back surface of a non-absorbent support, opposite to the surface provided with an ink-receiving layer, whereby the hue change of a printed image can be reduced.

Components contained in the ink-jet recording medium of the invention will be described below.

In an embodiment of the invention, a water-absorbent layer containing the water-absorbent polymer and an inorganic pigment is disposed on the back surface of the ink-jet recording medium. Another layer may be formed on the back surface if necessary.

<<Water-absorbent Layer>>

In the invention, the water-absorbent layer contains the water-absorbent polymer and an inorganic pigment. The water-absorbent layer may contain another additive if necessary.

(Water-absorbent Polymer)

In the invention, the water-absorbent polymer means a polymer that can absorb pure water such that the weight of absorbed pure water is at least 20 times the weight of the polymer per se.

The water-absorbent polymer preferably has a higher water absorption capacity. It is preferred that the water-absorbent polymer can absorb pure water such that the weight of absorbed pure water is at least 30 (more preferably at least 40) times the weight of the polymer.

The water-absorbent polymer may be selected from known polymers, and examples thereof include polyacrylate polymers, polyalkylene oxide polymers, starches, starch/acrylonitrile copolymers, water-soluble cellulose derivatives, isobutylene/maleate-based polymers, PVA/polyacrylate copolymers, vinyl acetate/methyl acrylate copolymers, vinyl acetate/monomethyl maleate copolymers, and polysaccharide/acrylic acid copolymers.

In view of water absorption rate and handling, the water-absorbent polymer is preferably a polyacrylate polymer, a polyalkylene oxide polymer, a starch, or a water-soluble cellulose derivative, more preferably a polyalkylene oxide polymer or a water-soluble cellulose derivative.

Examples of the polyacrylate polymers include sodium polyacrylates. Examples of the polyalkylene oxide polymers include polyethylene oxides and polypropylene oxides. Examples of the water-soluble cellulose derivatives include hydroxymethyl celluloses, hydroxypropyl celluloses, and carboxymethyl celluloses.

(Water Absorption Capacity of Back-Surface Water-Absorbent Layer)

The water absorption capacity is determined based on the amount of pure water transferred in 1 second by the Bristow method according to J. TAPPI, Paper and pulp testing method No. 51-87, the disclosure of which is incorporated by reference in its entirety.

In the invention, the water-absorbent layer preferably has a higher water absorption capacity. The amount of the pure water transferred to the back-surface water-absorbent layer is preferably 2 to 15 g/m$^2$, more preferably 4 to 10 g/m$^2$.

When the transfer amount is 2 to 15 g/m$^2$, the hue change of a printed ink can be preferably reduced.

In the invention, in view of the water transfer amount and prevention of curling and blocking, the amount of the water-absorbent polymer in the water-absorbent layer is preferably 0.5 to 20 g/m$^2$, more preferably 2 to 10 g/m$^2$.

(Pigment)

In the invention, the water-absorbent layer contains a pigment, which can act to reduce surface tackiness and to prevent blocking.

The pigment may contain at least one of silicon dioxide, aluminum oxide, calcium carbonate, a kaolin, a mica, etc.

Further, the pigment may be a white inorganic pigment containing a talc, calcium sulfate, barium sulfate, titanium dioxide, zinc oxide, zinc sulfide, zinc carbonate, a satin white, aluminum silicate, a diatomaceous earth, calcium silicate, magnesium silicate, a synthetic amorphous silica, a colloidal silica, a colloidal alumina, a pseudo-boehmite, aluminum hydroxide, a lithopone, a zeolite, a hydrous halloysite, magnesium carbonate, magnesium hydroxide, etc., or an organic pigment containing at least one of a styrene-based plastic, an acrylic plastic, a polyethylene, a microcapsule, a urea resin, a melamine resin, etc.

In the invention, in view of reducing surface tackiness and preventing blocking, the ratio of the inorganic pigment to the water-absorbent polymer is preferably 5% to 70% by mass, more preferably 10% to 50% by mass, in the water-absorbent layer.

(Other Additives)

In the invention, the water-absorbent layer may contain an additive such as a surfactant, an antistat, a hardener, a dye, a dispersant, an ultraviolet absorber, an antioxidant, a leveling agent, an antiseptic, a viscosity stabilizer, or a pH regulator, if necessary.

The water-absorbent layer may be formed on the support by a common coating method such as a slide hopper, curtain, extrusion, air knife, roll, rod, or wire bar coating method. The amount of the water-absorbent layer applied is not particularly limited, and is preferably 0.5 to 20 g/m$^2$, more preferably 2 to 10 g/m$^2$ in terms of solid amount.

<<Ink-receiving Layer>>

In the invention, the ink-receiving layer contains an inorganic pigment and a binder, and may further contain an additive if necessary.

(Inorganic Pigment)

The inorganic pigment preferably comprises a fine particle of an inorganic pigment (hereinafter referred to as inorganic fine particle).

The inorganic fine particle may contain at least one of a fine silica particle, a colloidal silica, titanium dioxide, barium sulfate, calcium silicate, a zeolite, a kaolinite, a halloysite, a mica, a talc, calcium carbonate, magnesium carbonate, calcium sulfate, a boehmite, a pseudo-boehmite, etc. Among them, the fine silica particle is preferred.

The fine silica particle has a remarkably large specific surface area, and thereby is excellent in ink absorbency and ink retention efficiency. Further, the fine silica particle has a low refraction index, and thus, by finely dispersing the particles with appropriate small particle diameters, the ink-receiving layer can be made transparent, resulting in high color density and excellent coloration. Such transparency of the ink-receiving layer is important not only in an application requiring the transparency such as OHP, but also in a recording sheet such as gloss photo paper, in view of achieving high color density, excellent coloration, and excellent glossiness.

The average primary particle diameter of the inorganic fine particle is preferably 20 nm or less, more preferably 15 nm or less, particularly preferably 10 nm or less. When the average primary particle diameter is 20 nm or less, the ink-absorbing property of the ink-receiving layer can be effectively increased, and also the surface glossiness of the ink-receiving layer can be improved.

The specific surface area of the inorganic fine particle, measured by a BET method, is preferably 200 m$^2$/g or more, more preferably 250 m$^2$/g or more, particularly preferably 380 m$^2$/g or more. When the specific surface area is 200 m$^2$/g or more, the ink-receiving layer can be high in transparency and printing density.

In the invention, the BET method is one method of measuring a specific surface area of a powder using a gas phase adsorption method, and thereby obtaining the total surface area of 1 g of a sample (i.e. the specific surface area) from an adsorption isotherm. In this method, most commonly, the gas to be adsorbed is nitrogen gas, and the amount of the adsorbed gas is measured based on the pressure or volume change of the gas. The BET (Brunauer-Emmett-Teller) equation is the most prominent among equations for representing a multimolecular adsorption isotherm, and has been widely used for obtaining surface area. The amount of the adsorbed gas is calculated based on the BET equation, and multiplied by the area of one adsorbed molecule on the surface, to obtain the surface area.

In particular, the fine silica particle has a surface silanol group, and the particles can be easily connected to each other by hydrogen bonds between the silanol groups. Particularly, the particles can be effectively bonded to each other by the silanol group present in a water-soluble resin. Thus, when the fine silica particles have an average primary particle diameter of 20 nm or less as described above, a structure of the ink-receiving layer having both high porosity and transparency is formed, and thereby an ink-absorbing property is effectively increased.

The fine silica particle is generally classified, depending on the production method, into a wet process particle or a dry process (gas phase process) particle. In a common wet process, a silicate salt is decomposed with an acid to generate an active silica, which is moderately polymerized and precipitated to obtain a hydrous silica. On the other hand, in a common gas phase process, a silicon halide is hydrolyzed in a gas phase at a high temperature (by a flame hydrolysis method), or alternatively a silica sand and a coke are heated, reduced, and gasified using an arc in an electric furnace, and then air-oxidized (by an arc method), to obtain an anhydrous silica. The gas phase process silica is a fine anhydrous silica particle obtained by such a gas phase process.

Gas phase process silica is different from hydrous silica in properties such as surface silanol group density, presence of pores, and the like, but gas phase process silica is suitable for forming a three-dimensional structure with a high porosity. The reason therefor is unclear, but it is thought that fine hydrous silica particles have a high surface silanol group density of 5 to 8 groups/nm$^2$, and thus the particles can be densely aggregated. On the other hand, fine gas phase process silica particles have a low surface silanol group density of 2 to 3 groups/nm$^2$, and thus the particles are aggregated only sparsely (flocculated). It is therefore assumed that gas phase process silica can form a three-dimensional structure with a high porosity because of this property.

In the invention, fine silica particles are preferably fine gas phase process silica particles (anhydrous silica particles) produced by the above dry process. The fine silica particles preferably have a surface silanol group density of 2 to 3 groups/nm$^2$.

In the invention, it is most preferred that the inorganic fine particles are gas phase process silica particles having a specific surface area of 200 $m^2/g$ or more as measured by the BET method.

(Binder)

The binder contained in the ink-receiving layer may comprise a polyvinyl alcohol.

The polyvinyl alcohol used in the invention is not particularly limited, and preferably has a saponification degree of 85 mol % or more. When the saponification degree of the polyvinyl alcohol is less than 85 mol %, the color hue of the neutral tone is different from neutral gray disadvantageously, and a coating liquid using the binder has a high viscosity, thereby resulting in low coating stability.

In the invention, the polymerization degree of the polyvinyl alcohol is preferably 1500 to 3600, more preferably 2000 to 3500. When the polymerization degree is less than 1500, the ink-receiving layer is often cracked. When the polymerization degree is more than 3600, the coating liquid disadvantageously has a high viscosity.

In the invention, the polyvinyl alcohol may be used in combination with a water-soluble resin other than the polyvinyl alcohol. Examples of the water-soluble resins for the combination with the polyvinyl alcohol include resins having a hydroxyl group as a hydrophilic structural unit such as polyvinyl alcohols (PVA) having a saponification degree not within the above range, cation-modified polyvinyl alcohols, anion-modified polyvinyl alcohols, silanol-modified polyvinyl alcohols, polyvinyl acetals, cellulose-based resins (methyl celluloses (MC), ethyl celluloses (EC), hydroxyethyl celluloses (HEC), carboxymethyl celluloses (CMC), hydroxypropyl celluloses (HPC), etc.), chitins, chitosans, and starches; resins having a hydrophilic ether bond such as polyethylene oxides (PEO), polypropylene oxides (PPO), polyethylene glycols (PEG), and polyvinyl ethers (PVE); and resins having a hydrophilic amide group or amide bond such as polyacrylamides (PAAM) and polyvinylpyrrolidones (PVP). Further, examples include resins having a carboxyl group as a dissociable group such as polyacrylates, maleic resins, alginates, and gelatins.

In the invention, in the case of using the combination of the polyvinyl alcohol according to the invention and other water-soluble resins described above, the mass ratio of the polyvinyl alcohol according to the invention to the total of the combination is preferably 1% to 30%, more preferably 3% to 20%, particularly preferably 6% to 12%.

When the mass ratio of the binder to the total of solid contents in the ink-receiving layer is too low, the layer strength may be lowered, and the layer may be cracked in a drying process. When the mass ratio is too high, the pores in the layer may be easily filled with the resin, whereby the porosity is lowered, resulting in poor ink absorbency. In the invention, the mass ratio of the binder is preferably 9% to 40%, more preferably 12% to 33%, in view of preventing these disadvantages.

The polyvinyl alcohol has a hydroxyl group in its structural unit. The hydroxyl group can form a hydrogen bond with the surface silanol group of the fine silica particle, and thus a three-dimensional network structure containing secondary fine silica particles as chain units can be easily formed. In the case of forming such a three-dimensional network structure, the resultant ink-receiving layer can have a porous structure with a high porosity.

In the ink-jet recording medium, the porous ink-receiving layer formed in the above manner can rapidly absorb an ink by capillarity, and can form a dot with excellent circularity without ink bleeding.

(Content Ratio of Inorganic Fine Particle and Binder)

The layer structure of the ink-receiving layer is largely affected by the content ratio of the inorganic fine particle (preferably the fine silica particle, x) and the binder (y), namely the PB ratio (the mass of the inorganic fine particle per 1 part by mass of the binder, x/y). Thus, as the PB ratio is increased, also the porosity, the pore volume, and the surface area (per unit area) are increased. Specifically, when the PB ratio (x/y) is too high, the layer strength may be lowered, and the layer may be cracked in a drying process. When the PB ratio is too low, the pores in the layer may be easily filled with the resin, whereby the porosity is lowered, resulting in poor ink absorbency. The PB ratio is preferably 1.5/1 to 10/1 in view of preventing these disadvantages.

When the ink-jet recording medium is moved in a transfer system of an ink-jet printer, a stress is often applied to the medium. Thus, the ink-receiving layer has to be sufficient in layer strength. Such sufficient layer strength is necessary also for preventing cracking, peeling, or the like of the ink-receiving layer in a process of cutting the medium into a sheet. It is preferred from these viewpoints that the PB ratio (x/y) is 5/1 or less. Further, it is preferred from the viewpoint of achieving a fast ink absorption in an ink-jet printer that the PB ratio is 2/1 or more.

For example, in a case where the fine anhydrous silica particle having an average primary particle diameter of 20 nm or less and the polyvinyl alcohol are completely dispersed in an aqueous solution at a PB ratio (x/y) of from 2/1 to 5/1 to prepare a coating liquid, and the coating liquid is applied to and dried on the support, the three-dimensional network structure containing secondary fine silica particles as chain units can be easily formed to prepare a light-transmissive porous layer having an average pore diameter of 30 nm or less, a porosity of 50% to 80%, a specific pore volume of 0.5 ml/g or more, and a specific surface area of 100 $m^2/g$ or more.

(Crosslinking Agent)

In the invention, the ink-receiving layer may contain a crosslinking agent. The ink-receiving layer is preferably a porous layer formed from polyvinyl alcohol and one or more optional water-soluble resins and cured by crosslinking with the crosslinking agent.

The crosslinking agent may be appropriately selected depending on the type of the binder (particularly the polyvinyl alcohol and the optional water-soluble resins) in the ink-receiving layer. The crosslinking agent is preferably a boron compound suitable for rapidly carrying out a crosslinking reaction, and examples thereof include borax, boric acid, borate salts (such as orthoborate salts, $InBO_3$, $ScBO_3$, $YBO_3$, $LaBO_3$, $Mg_3(BO_3)_2$, and $Co_3(BO_3)_2$), diborate salts (such as $Mg_2B_2O_5$ and $Co_2B_2O_5$), metaborate salts (such as $LiBO_2$, $Ca(BO_2)_2$, $NaBO_2$, and $KBO_2$), tetraborate salts (such as $Na_2B_4O_7 \cdot 10H_2O$), and pentaborate salts (such as $KB_5O_8 \cdot 4H_2O$, $Ca_2B_6O_{11} \cdot 7H_2O$, and $CsB_5O_5$). Among them, in view of rapidly carrying out the crosslinking reaction, preferred are borax, boric acid, and borate salts, and particularly preferred are boric acid and borate salts. It is most preferred that such preferable boron compounds are used in combination with the water-soluble resin of a polyvinyl alcohol.

In the invention, the amount of the crosslinking agent is preferably 0.05 to 0.50 parts by mass, more preferably 0.08 to 0.30 parts by mass, per 1.0 part by mass of the binder. When the amount of the crosslinking agent is within this range, the binder can be effectively crosslinked to prevent cracking, etc.

In the case of using gelatins as the water-soluble resin, the crosslinking agent may be a compound other than the boron compound, and examples thereof include aldehyde compounds such as formaldehyde, glyoxal, and glutaraldehyde; ketone compounds such as diacetyl and cyclopentanedione; active halide compounds such as bis(2-chloroethylurea)-2-hydroxy-4,6-dichloro-1,3,5-triazine and sodium salts of 2,4-dichloro-6-S-triazine; active vinyl compounds such as divinylsulfonic acid, 1,3-vinylsulfonyl-2-propanol, N,N'-ethylene bis(vinylsulfonylacetamide), and 1,3,5-triacryloyl-hexahydro-S-triazine; N-methylol compounds such as dimethylolurea and methyloldimethylhydantoin; melamine resins such as methylolmelamine and alkylated methylolmelamines; epoxy resins;

isocyanate compounds such as 1,6-hexamethylene diisocyanate; aziridine compounds described in U.S. Pat. No. 3,017,280 and U.S. Pat. No. 2,983,611; carboxyimide compounds described in U.S. Pat. No. 3,100,704; epoxy compounds such as glycerol triglycidyl ether; ethyleneimino compounds such as 1,6-hexamethylene-N,N'-bisethyleneurea; halogenated carboxyaldehyde compounds such as mucochloric acid and mucophenoxychloric acid; dioxane compounds such as 2,3-dihydroxydioxane; metal-containing compounds such as titanium lactate, aluminum sulfate, chromium alum, potash alum, zirconyl acetate, and chromium acetate; polyamine compounds such as tetraethylenepentamine; hydrazide compounds such as adipic acid dihydrazide; and low-molecular compounds and polymers having 2 or more oxazoline groups. The crosslinking agents may be used singly or in combination of two or more.

(Water-soluble Aluminum Compound)

In the invention, the ink-receiving layer may contain a water-soluble aluminum compound. By using the water-soluble aluminum compound, the image formed on the recording medium can be improved with respect to resistance to water and bleeding with time.

Examples of known water-soluble aluminum compounds include inorganic salts such as aluminum chloride and hydrates thereof, aluminum sulfate and hydrates thereof, and ammonium alum. Further examples include basic polyaluminum hydroxide compound and inorganic aluminum-containing cationic polymers. Among them, the basic polyaluminum hydroxide compounds are preferred.

The basic polyaluminum hydroxide compound is a water-soluble polyaluminum hydroxide that has a main component represented by the following formula 1, 2, or 3 and contains a basic high-molecular polynuclear condensed ion such as $[Al_6(OH)_{15}]^{3+}$, $[Al_8(OH)_{20}]^{4+}$, $[Al_{13}(OH)_{34}]^{5+}$, or $[Al_{21}(OH)_{60}]^{3+}$ in the stable state.

$[Al_2(OH)_nCl_{6-n}]_m$ ($5<m<80$, $1<n<5$) Formula 1

$[Al(OH)_3]_nAlCl_3$ ($1<n<2$) Formula 2

$Al_n(OH)_mCl_{(3n-m)}$ ($0<m<3n$, $5<m<8$, $3<n<80$) Formula 3

Various grades of such water-soluble polyaluminum hydroxides are easily commercially available from various manufacturers, and examples of commercially-available ones include Polyaluminum Chloride (PAC) water treatment agents available from Taki Chemical Co., Ltd., Polyaluminum Hydroxides (Paho) available from Asada Chemical Industry Co., Ltd., PURACHEM WT available from Rikengreen Co., Ltd., and ALUFINE available from Taimei Chemicals Co., Ltd. In the invention, the commercially-available polyaluminum hydroxide may be used without modification. When the commercially-available polyaluminum hydroxide has an unsuitably low pH, it may be used in the invention after appropriately controlling the pH.

In the invention, the ratio of the water-soluble aluminum compound to the total of solid contents in the ink-receiving layer is preferably 0.1% to 20% by mass, more preferably 1% to 8% by mass, most preferably 2% to 4% by mass. When the ratio of the water-soluble aluminum compound is within the range of 2% to 4% by mass, the effects of increasing glossiness, water resistance, gas resistance, and light resistance are particularly improved.

(Zirconium Compound)

In the invention, the ink-receiving layer may contain a zirconium compound. The zirconium compound has an effect of increasing water resistance.

The zirconium compound used in the invention is not particularly limited, and examples thereof include zirconyl acetate, zirconium chloride, zirconium oxychloride, zirconium hydroxychloride, zirconium nitrate, basic zirconium carbonate, zirconium hydroxide, ammonium zirconium carbonate, potassium zirconium carbonate, zirconium sulfate, and zirconium fluoride. Particularly preferred is zirconyl acetate.

In the invention, the ratio of the zirconium compound to the total of solid contents in the ink-receiving layer is preferably 0.05% to 5.0% by mass, more preferably 0.1% to 3.0% by mass, most preferably 0.5% to 2.0% by mass. When the ratio of the zirconium compound is within the range of 0.5% to 2.0% by mass, the water resistance can be particularly increased without deterioration of ink absorbency.

In the invention, a further water-soluble polyvalent metal compound other than the water-soluble aluminum compound and the zirconium compound may be used. For example, the water-soluble polyvalent metal compound may be a water-soluble salt of a metal selected from calcium, barium, manganese, copper, cobalt, nickel, iron, zinc, chromium, magnesium, tungsten, and molybdenum. Specific examples of the polyvalent metal compounds include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, cupric chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, ferrous bromide, ferrous chloride, ferric chloride, ferrous sulfate, ferric sulfate, zinc bromide, zinc chloride, zinc nitrate hexahydrate, zinc sulfate, chromium acetate, chromium sulfate, magnesium sulfate, magnesium chloride hexahydrate, magnesium citrate nonahydrate, sodium phosphotungstate, tungsten sodium citrate, 12-tungstophosphoric acid n-hydrate, 12-tungstosilicic acid 26-hydrate, molybdenum chloride, and 12-molybdophosphoric acid n-hydrate.

(Other Components)

In the invention, the ink-receiving layer may contain the following components if necessary.

Thus, the ink-receiving layer may contain an anti-fading agent such as an ultraviolet absorber, an antioxidant, or a singlet oxygen quencher to prevent the deterioration of a color material in an ink.

The ultraviolet absorber may be at least one of a cinnamic acid derivative, a benzophenone derivative, a benzotriazolylphenol derivative, etc. Examples thereof include butyl α-cyanophenylcinnamate, o-benzotriazole phenol, o-benzotriazole-p-chlorophenol, o-benzotriazole-2,4-di-t-butylphenol, and o-benzotriazole-2,4-di-t-octylphenol. Also a hindered phenol compound may be used as the ultraviolet absorber, and specifically it is preferably a phenol derivative having a branched alkyl group at at least one of 2- and 6-positions.

Further, the ultraviolet absorber may be a benzotriazole-, salicylic acid-, cyano acrylate-, or oxalic acid anilide-based ultraviolet absorber. Such ultraviolet absorbers are described in JP-A Nos. 47-10537, 58-111942, 58-212844, 59-19945, 59-46646, 59-109055, and 63-53544, JP-B Nos. 36-10466, 42-26187, 48-30492, 48-31255, 48-41572, 48-54965, and 50-10726, U.S. Pat. Nos. 2,719,086, 3,707,375, 3,754,919, and U.S. Pat. No. 4,220,711, etc.

Also a fluorescent whitening agent may be used as the ultraviolet absorber. For example, the fluorescent whitening agent may be a coumarin-based agent or the like. Specific examples thereof are described in JP-B Nos. 45-4699 and 54-5324, etc.

Examples of the above antioxidants include those described in EP-A Nos. 223739, 309401, 309402, 310551, 310552, and 459416, DE-A No. 3,435,443, JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381, and 63-113536, JP-A Nos. 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437, and 5-170361, JP-B Nos. 48-43295 and 48-33212, and U.S. Pat. Nos. 4,814,262 and 4,980,275.

Specific examples of the antioxidants include 6-ethoxy-1-phenyl-2,2,4-trimethyl-1,2-dihydroquinoline,
6-ethoxy-1-octyl-2,2,4-trimethyl-1,2-dihydroquinoline,
6-ethoxy-1-phenyl-2,2,4-trimethyl-1,2,3,4-tetrahydroquinoline,
6-ethoxy-1-octyl-2,2,4-trimethyl-1,2,3,4-tetrahydroquinoline, nickel cyclohexane-butyrate,
2,2-bis(4-hydroxyphenyl)propane, 1,1-bis(4-hydroxyphenyl)-2-ethylhexane,
2-methyl-4-methoxy-diphenylamine, and 1-methyl-2-phenylindole.

These anti-fading agents may be used singly or in combination of two or more. The anti-fading agent may be water-solubilized, dispersed, or emulsified, and may be contained in a microcapsule. The content of the anti-fading agent in a liquid for forming the ink-receiving layer is preferably 0.01% to 10% by mass.

In the invention, the ink-receiving layer may contain a high-boiling organic solvent for preventing curling. The high-boiling organic solvent is preferably water soluble, and examples of the water-soluble high-boiling organic solvents include alcohol compounds such as ethylene glycol, propylene glycol, diethylene glycol, triethylene glycol, glycerin, diethylene glycol monobutyl ether (DEGMBE), triethylene glycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine, and polyethylene glycols having a weight-average molecular weight of 400 or less. The high-boiling organic solvent is preferably diethylene glycol monobutyl ether (DEGMBE).

The content of the high-boiling organic solvent in a liquid for forming the ink-receiving layer is preferably 0.05% to 1% by mass, particularly 0.1% to 0.6% by mass.

The ink-receiving layer may contain an inorganic salt for improving dispersion of the inorganic fine particle, and may contain an acid or an alkali as a pH adjuster.

The ink-receiving layer may contain a fine electron-conductive metal oxide particle for preventing frictional electrification or peeling electrification of the surface. Furthermore, the ink-receiving layer may contain a matting agent for reducing surface friction.

(Support)

A non-absorbent support is used in the invention. The non-absorbent support does not absorb water or a solvent contained in an ink for recording, particularly water.

The non-absorbent support may be a transparent support containing a transparent material such as a plastic or an opaque support containing opaque material such as paper. The non-absorbent support is preferably a transparent support or an opaque support with a high glossiness in view of taking advantage of the transparency of the ink-receiving layer. A read-only optical disc such as CD-ROM or DVD-ROM, a recordable optical disc such as CD-R or DVD-R, or a rewritable optical disc may be used as the support, the ink-receiving layer being formed on the label surface.

The transparent support is preferably composed of a transparent material that is resistant to radiation heat generated in an OHP device, a backlight display, etc. Examples of such materials include polyesters such as polyethylene terephthalates (PET), polysulfones, polyphenylene oxides, polyimides, polycarbonates, and polyamides. Among the materials, preferred are polyesters, particularly polyethylene terephthalates.

The thickness of the transparent support is not particularly limited, and is preferably 50 to 200 μm in view of handling.

The high-gloss opaque support is preferably such that the surface to be provided with the ink-receiving layer has a glossiness of 40% or more. The glossiness is a value obtained in accordance with a method described in JIS P-8142 (a testing method for 75-degree specular gloss of paper and paperboard). Specifically, the opaque support may be the following one.

For example, the opaque support may be a high-gloss film prepared by adding a white pigment or the like to a plastic film of a polyester (such as a polyethylene terephthalate (PET)), a cellulose ester (such as a nitrocellulose, a cellulose acetate, or a cellulose acetate butyrate), a polysulfone, a polyphenylene oxide, a polyimide, a polycarbonate, a polyamide, or the like to opacify the film. The high-gloss film may be subjected to a calender surface treatment. Alternatively, the opaque support may be a support prepared by forming a polyolefin coating layer containing, or not containing, a white pigment on a surface of a paper support, the above transparent support, or the above high-gloss film containing the white pigment or the like.

Also a white pigment-containing foamed polyester film (such as a foamed PET film prepared by adding fine polyolefin particles to a PET and by stretching to form voids) can be preferably used as the opaque support. Further, a resin-coated paper, which can be used as a silver salt photographic printing paper, can be preferably used as the support.

The thickness of the opaque support is not particularly limited, and is preferably 50 to 300 μm in view of handling.

The surface of the support is preferably subjected to a corona discharge treatment, a glow discharge treatment, a flame treatment, an ultraviolet irradiation treatment, etc. to improve the wetting characteristic and the adhesiveness.

Next, a base paper for a paper support composed of the resin-coated paper or the like will be described below.

The base paper may be produced using a wood pulp as a main material. A synthetic pulp such as a polypropylene, or a synthetic fiber such as a nylon or a polyester may be added to the wood pulp if necessary. The wood pulp may be LBKP, LBSP, NBKP, NBSP, LDP, NDP, LUKP, or NUKP, and it is preferable to use the short fiber-rich LBKP, NBSP, LBSP, NDP, or LDP in a larger amount. It should be noted that the content of the LBSP and/or LDP is preferably 10% to 70% by mass.

The pulp is preferably a chemical pulp with a low impurity content (such as a sulfate pulp or a sulfurous acid pulp), or a pulp with a high whiteness improved by a bleaching treatment.

A sizing agent (such as a higher fatty acid or an alkyl ketene dimer), a white pigment (such as calcium carbonate, a talc, or titanium oxide), a paper-reinforcing agent (such as a starch, a polyacrylamide, or a polyvinyl alcohol), a fluorescent whitening agent, a water retention agent (such as a polyethylene glycol compound), a dispersant, a softening agent (such as a quaternary ammonium), etc. may be appropriately added to the base paper.

The freeness of the pulp used for the paper making, obtained according to CSF, is preferably 200 to 500 ml. The fiber length after the beating is preferably such that the total mass ratio of the 24 mesh residue and the 42 mesh residue, stipulated in JIS P-8207, is 30% to 70% by mass. The mass ratio of the 4 mesh residue is preferably 20% by mass or less.

The basis weight of the base paper is preferably 30 to 250 g, particularly 50 to 200 g. The thickness of the base paper is preferably 40 to 250 μm. The base paper may be subjected to a calender treatment in or after the papermaking to improve the smoothness. The density of the base paper, measured according to JIS P-8118, is generally 0.7 to 1.2 g/m$^2$. The stiffness of the base paper is preferably 20 to 200 g under the condition of JIS P-8143.

A surface sizing agent may be applied to the base paper. The surface sizing agent may be the same as the sizing agent added into the base paper.

The pH of the base paper, measured by a hot water extraction method according to JIS P-8113, is preferably 5 to 9.

The front surface and the back surface of the base paper may be covered with a polyethylene, generally with a low-density polyethylene (LDPE) and/or a high-density polyethylene (HDPE). An LLDPE, a polypropylene, or the like may be used in addition to the polyethylene.

Particularly the polyethylene layer on the ink-receiving layer side preferably contains at least one of a rutile- or anatase-type titanium oxide, a fluorescent whitening agent, an ultramarine pigment, etc. for improving the opacity, whiteness, and hue, as is often the case with photographic printing papers. The ratio of the titanium oxide to the polyethylene is preferably 3% to 20% by mass, more preferably 4% to 13% by mass. The thickness of the polyethylene layer on the front or back surface is not particularly limited, and is preferably 10 to 50 μm. An undercoat layer may be formed on the polyethylene layer to increase the adhesion to the ink-receiving layer. The undercoat layer preferably contains an aqueous polyester, a gelatin, or a PVA. The thickness of the undercoat layer is preferably 0.01 to 5 μm.

The polyethylene-coated paper may be used as a glossy paper, and may be such that the base paper is subjected to a so-called printing treatment in the process of melt-extruding the polyethylene onto the base paper surface to coat the surface, thereby forming a mat surface or a fine grain surface as common photographic printing paper.

On the back surface of the support, another layer may be formed in addition to the water-absorbent layer if necessary, as long as the layer does not deteriorate the advantageous effects of the invention.

For example, the ink-jet recording medium of the invention may be produced by the steps of: preparing the resin-coated paper (the polyethylene-coated paper); applying the after-mentioned water-absorbent layer coating liquid to the back surface of the paper (the surface opposite to the surface to be provided with the ink-receiving layer) using a known method; drying the applied liquid to form the water-absorbent layer; applying the after-mentioned ink-receiving layer coating liquid to the front surface of the paper (the surface opposite to the surface provided with the water-absorbent layer); and drying the applied liquid to form the ink-receiving layer.

In another example, the ink-jet recording medium of the invention may be produced by performing the steps of: applying an ink-receiving layer coating liquid A containing at least the inorganic pigment and the binder to the surface of the resin-coated paper (the surface opposite to the surface provided with the water-absorbent layer); adding a basic solution (liquid B) having a pH of 7.1 or more to the liquid A, either (a) simultaneously with application of the liquid A, or (b) after application of the liquid A, but before the drying rate of the applied layer begins to decrease when drying the liquid A; and crosslinking and hardening the coating layer to which the liquid B has been added.

The crosslinking agent may be added to at least one of the inorganic pigment-containing liquid A and the liquid B. In this case, the ink-receiving layer can be porous, and can be crosslinked and hardened by the addition of the liquid B. The resultant ink-receiving layer is excellent in ink absorbency and preferred from the viewpoint of preventing the cracking or crazing of the layer. Thus, in the case of using the resin-coated paper in the invention, the cracking or crazing of the ink-receiving layer can be reduced, and the brittleness of the ink-receiving layer can be improved.

For example, the ink-receiving layer coating liquid containing the inorganic pigment (such as the gas phase process silica) and the binder (such as the polyvinyl alcohol) may be prepared as follows: the inorganic pigment (such as the gas phase process silica) and a dispersant are added to water (e.g. the fine silica particle content in water being 10% to 20% by mass); the inorganic pigment is dispersed in the mixture at a high rotational speed of e.g. 10,000 rpm (preferably 5,000 to 20,000 rpm) for e.g. 20 minutes (preferably 10 to 30 minutes) by a bead mill (such as KD-P available from Shima Enterprise); an aqueous polyvinyl alcohol (PVA) solution is added to the mixture, for example, so as to ajust the mass ratio of the PVA to the gas phase process silica to about ⅓; and the resulting mixture is subjected to a dispersion treatment under the above conditions. To improve the stability of the coating liquid, it is preferable to control the pH at approximately 9.2 with aqueous ammonia, or the like or to use the dispersant.

In the above preparation, the dispersion treatment may be carried out using an ultrasonic disperser (available from SMT Co., Ltd.) instead of the bead mill, for example under heating at 45° C. for 20 hours. Also in this case, to improve the stability of the coating liquid, it is preferable to adjust the pH to approximately 9.2 with an aqueous ammonia, or the like or to use the dispersant.

Thus-obtained coating liquid is in a uniform sol state, and may be applied onto the resin-coated paper by the after-mentined coating method and dried, to form the ink-receiving layer having a porous three-dimensional network structure.

The aqueous dispersion containing the inorganic pigment (such as the gas phase process silica) and the dispersant may be prepared by dispersing the gas phase process silica in water, and by adding the obtained aqueous silica dispersion liquid to an aqueous dispersant solution. Or alternatively, the aqueous dispersion may be prepared by adding the aqueous dispersant solution to the aqueous silica dispersion liquid, or by mixing the liquids simultaneously. A powdery gas phase process silica may be used instead of the aqueous silica dispersion liquid, and may be added to the aqueous dispersant solution.

The mixture liquid of the gas phase process silica and the dispersant may be subjected to an atomization treatment using a disperser to obtain an aqueous dispersion liquid having an average particle diameter of 50 nm or less.

The solvent for the above preparation may be water, an organic solvent, or a mixture thereof. Examples of the organic solvents usable in the application process include alcohols (such as methanol, ethanol, n-propanol, i-propanol, and methoxypropanol), ketones (such as acetone and methyl ethyl ketone), tetrahydrofuran, acetonitrile, ethyl acetate, and toluene.

A dispersant may be added to the coating liquid to improve the dispersion property of the liquid. The dispersant is not particularly limited, and may be a known cationic resin. The ratio of the dispersant to the inorganic fine particle is preferably 0.1 % to 30%, more preferably 1%to 10%.

For example, the coating liquid may be applied by a known coating method using an extrusion die coater, an air doctor coater, a blade coater, a rod coater, a knife coater, a squeeze coater, a reverse roll coater, a bar coater, or the like.

The liquid B may be added to the liquid A simultaneously with application of the liquid A. Alternatively, the liquid B may be added to the liquid A after application, but before the drying rate of the applied layer begins to decrease when drying the liquid A. In other words, the liquid B may be added to the applied liquid A to form the crosslinked and hardened porous layer while the applied liquid A layer exhibits a constant drying rate.

The liquid B may contain a crosslinking agent, a mordant, etc. if necessary.

The liquid B may be an alkali solution capable of accelerating the hardening. The pH of the liquid B is adjusted to preferably 7.1 or more, more preferably 7.5 or more, particularly preferably 7.9 or more. When the pH is within the range, the crosslinking reaction of the binder in the liquid A can be preferably carried out, and defects such as bronzing and cracking can be prevented in the ink-receiving layer.

The time "before the applied liquid A layer shows a falling drying rate" is generally a period of several minutes from the application of the coating liquid. During the several minutes, the amount of a solvent (a dispersion medium) in the applied liquid A layer is reduced in proportion to time, and thus the applied liquid A layer shows a constant drying rate. The period at the constant drying rate is described in *Kagaku Kogaku Binran*, Page 707 to 712, Maruzen Co., Ltd., Oct. 25, 1980, etc.

In this case, the applied coating liquid may be generally dried at 40° C. to 180° C. for 0.5 to 10 minutes (preferably 0.5 to 5 minutes). This drying time is generally preferred, though the suitable drying time depends on the amount of the applied liquid as a matter of course.

<Ink-jet Recording Method>

The ink-jet recording method of the invention comprises subjecting a stack of a plurality of the ink-jet recording media of the invention to a pressure treatment after printing.

The recording method is advantageous in that, by subjecting the stack of the ink-jet recording media to the pressure treatment after the printing so that the front surface of a medium contacts the back surface of an adjacent medium, the absorption of water, a solvent, etc. contained in an ink introduced in the front-side ink-receiving layer can be accelerated to efficiently prevent the hue change.

The process for the pressure treatment is not limited as long as the process is capable of applying a pressure of 0.01 to 10 kPa for 100 milliseconds or more. For example, in the pressure treatment, the stack may be sandwiched between rubber or metal rollers or between sheets.

EXAMPLES

The present invention will be more specifically described below with reference to Examples without intension of restricting the scope of the invention. It should be noted that "part(s)" and "%" described in Examples means "part(s) by mass" and "% by mass" respectively, unless otherwise noted.

Example 1

<<Preparation of Water-resistant Support>>

<Preparation of Water-resistant Support A>

50 parts of an acacia LBKP and 50 parts of an aspen LBKP were beaten by a disc refiner into Canadian Freeness of 300 ml respectively, to prepare a pulp slurry.

To the pulp slurry were added 1.3% of a cationic starch (CATO 304L available from Nippon NSC Ltd.), 0.15% of an anionic polyacrylamide (POLYACRON ST-13 available from Seiko PMC Corporation), 0.29% of an alkyl ketene dimer (SIZEPINE K available from Arakawa Chemical Industries, Ltd.), 0.29% of an epoxidized behenic amide, and 0.32% of a polyamide polyamine epichlorohydrin (ARAFIX 100 available from Arakawa Chemical Industries, Ltd.), and thereto was further added 0.12% of an antifoaming agent. The ratios were based on the mass of the pulp.

The resultant pulp slurry was subjected to paper-making by a fourdrinier paper machine, and then dried. In the drying step, the felt surface of the web was pressed against a drum dryer cylinder via a dryer canvas, the tensile force of the dryer canvas being adjusted to 1.6 kg/cm. Then, a polyvinyl alcohol (KL-118 available from Kuraray Co., Ltd.) was applied at 1 $g/m^2$ to both the surfaces of the base paper by a size press, and the applied polyvinyl alcohol was dried and subjected to a calender treatment. The base paper (the raw paper) had a basis weight of 166 $g/m^2$ and a thickness of 160 μm.

The wire surface (the back side) of the obtained raw paper was subjected to a corona discharge treatment, and then coated with a high-density polyethylene by a melt extruder to form a 25 μm thick thermoplastic resin layer with a mat surface. The surface of the paper, provided with the thermoplastic resin layer, is hereinafter referred to as the back surface. The thermoplastic resin layer on the back surface was further subjected to a corona discharge treatment.

Then, a water-absorbent layer coating liquid A having the following composition was applied to the thermoplastic resin layer such that the dry mass was 2 $g/m^2$.

[Composition of Water-Absorbent Layer Coating Liquid A]

(1) 95 parts of methanol
(2) 5 parts of a polyalkylene oxide-based resin (AQUACOKE TWB available from Sumitomo Seika Chemicals Co., Ltd.)
(3) 0.5 parts of an inorganic pigment (MIZUKASIL P526 available from Mizusawa Industrial Chemicals, Ltd.)

Furthermore, the felt surface (the front side) of the base paper, opposite to the back surface provided with the thermoplastic resin layer, was subjected to a corona discharge treatment, and a low-density polyethylene composition was extruded in a thickness of 25 μm by a melt-extruder to form a high-gloss thermoplastic resin layer on the felt surface of the base paper, whereby a water-resistant support A was produced. The formed high-gloss surface is hereinafter referred to as the front surface. The low-density polyethylene composition contained 10% of an anatase-type titanium dioxide, 0.3% of an ultramarine pigment available from Tokyo Printing Ink Mfg. Co., Ltd., and 0.08% of a fluorescent whitening agent Whiteflour PSN conc available from Nippon Chemical Works Co., Ltd., and had an MFR (melt flow rate) of 3.8.

<Preparation of Water-resistant Support B>

A water-resistant support B was produced in the same manner as the water-resistant support A except for using a water-absorbent layer coating liquid B having the following composition instead of the water-absorbent layer coating liquid A on the back surface.

[Composition of Water-absorbent Layer Coating Liquid B]

(1) 20 parts of methanol (2) 75 parts of pure water (3) 5 parts of a hydroxypropyl cellulose (4) 0.5 parts of an inorganic pigment (MIZUKASIL P526 available from Mizusawa Industrial Chemicals, Ltd.)

<Preparation of Water-resistant Support C>

A water-resistant support C was produced in the same manner as the water-resistant support A except for using a water-absorbent layer coating liquid C having the following composition instead of the water-absorbent layer coating liquid A on the back surface.

[Composition of Water-absorbent Layer Coating Liquid C]

(1) 95 parts of ethyl acetate (2) 5 parts of a polyacrylate-based resin (AQUAKEEP 1 OSH-NF available from Sumitomo Seika Chemicals Co., Ltd.)

(3) 0.5 parts of an inorganic pigment (MIZUKASIL P526 available from Mizusawa Industrial Chemicals, Ltd.)

<Preparation of Water-resistant Support D>

A water-resistant support D was produced in the same manner as the water-resistant support A except that the application amount of the water-absorbent layer coating liquid A was reduced such that the water-absorbent layer on the back surface had a dry mass of 0.4 g/m$^2$.

<Preparation of Water-resistant Support E>

A water-resistant support E was produced in the same manner as the water-resistant support A except for using a water-absorbent layer coating liquid D having the following composition instead of the water-absorbent layer coating liquid A on the back surface.

[Composition of Water-absorbent Layer Coating Liquid D]

(1) 95 parts of pure water (2) 5 parts of a polyvinyl alcohol (PVA220 available from Kuraray Co., Ltd.)

(3) 0.5 parts of an inorganic pigment (MIZUKASIL P526 available from Mizusawa Industrial Chemicals, Ltd.)

<Preparation of Water-resistant Support F>

A water-resistant support F was produced in the same manner as the water-resistant support A except for using a water-absorbent layer coating liquid E having the following composition instead of the water-absorbent layer coating liquid A on the back surface.

[Composition of Water-absorbent Layer Coating Liquid E]

(1) 95 parts of methanol (2) 5 parts of a polyalkylene oxide-based resin (AQUACOKE TWB available from Sumitomo Seika Chemicals Co., Ltd.)

<Preparation of Water-resistant Support G>

A water-resistant support G was produced in the same manner as the water-resistant support A except that the water-absorbent layer was not formed on the back surface.

<<Production of Ink-jet Recording Sheet>>

<Preparation of Ink-receiving Layer Coating Liquid>

(1) Fine gas phase process silica particles, (2) an ion-exchange water, (3) SHALLOL DC-902P, and (4) ZA-30 were mixed at the following composition, and dispersed by an ultrasonic disperser (available from SMT Co., Ltd.). The obtained dispersion liquid was heated at 45° C. for 20 hours, and then (5) boric acid, (6) an aqueous polyvinyl alcohol solution, and (7) a surfactant were added thereto at 30° C., to prepare an ink-receiving layer coating liquid.

<Composition of Ink-receiving Layer Coating Liquid>

(1) 10.0 parts of fine gas phase process silica particles (inorganic fine particles, AEROSIL 300SV available from Nippon Aerosil Co., Ltd.)

(2) 62.8 parts of an ion-exchange water (3) 0.87 parts of a 51.5% aqueous solution of a dispersant (SHALLOL DC-902P available from Dai-ichi Kogyo Seiyaku Co., Ltd.)

(4) 0.54 parts of a zirconyl acetate (ZA-30 available from Daiichi Kigenso Kagaku Kogyo Co., Ltd.)

(5) 0.37 parts of boric acid (a crosslinking agent)

(6) 29 parts of a 7% aqueous solution of a polyvinyl alcohol (JM33 available from Japan VAM & Poval Co., Ltd.)

(7) 0.07 parts of a surfactant (EMULGEN 109P)

-Production of Ink-jet Recording Sheet A-

The front surface of the water-resistant support A was subjected to a corona discharge treatment, and the ink-receiving layer coating liquid was applied at 22 g/m$^2$ to the front surface by a slide bead coater. After the application, the resultant was cooled at 5° C. for 1 minute and dried at 40° C., to produce an ink-jet recording sheet A.

-Production of Ink-jet Recording Sheets B to G-

Ink-jet recording sheets B to G were produced in the same manner as the ink-jet recording sheet A, using the water-resistant supports B to G and the ink-receiving layer coating liquid, respectively.

<<Image Printing>>

An image was printed on each of the ink-jet recording sheets A to G under the following conditions, and evaluated.

Five L-size sheets were cut out from the ink-jet recording sheet, and a solid gray image was continuously printed on the ink-receiving layers of the sheets by using a printer A820 manufactured by Seiko Epson Corporation, to prepare evaluation samples. The tone of the image data was controlled such that the gray level was approximately 1.7.

Further five L-size sheets were cut out from each of the ink-jet recording sheets A and B, and the solid gray image was continuously printed on the sheets in the above manner. Immediately after the printing, the sheets were subjected to a pressure treatment under a pressure of 1 kPa for 10 seconds, whereby further evaluation samples were prepared.

[Evaluation]

<Hue Change Evaluation Method>

The evaluation samples were left for 10 minutes on the catch tray in the stack state. The hues of the uppermost sheet and the third sheet were measured to obtain a color difference (ΔE).

The hue was measured based on L*a*b* by a spectrophotometer (SPECTROLINO manufactured by Gretag Macbeth) under a F8 light source and a view angle of 2 degrees.

The hue change of the sheet was evaluated using the color difference (ΔE) based on the following evaluation criteria.

Evaluation Criteria

A: The hue change was hardly visible (ΔE<2).

B: The hue change was not highly visible (2≦ΔE<4).

C: The hue change was highly visible (4≦ΔE<7).

D: The hue change was at a highly problematic level (7≦ΔE)

<Blocking Evaluation Method>

The stack of the evaluation samples was sandwiched between acrylic plates, a 5-kg weight was placed thereon, and this was left under conditions of 30° C. and 80% RH for 2 days. Subsequently, the evaluation samples were taken out, and the blocking of the five sheets was evaluated based on the following evaluation criteria.

Evaluation Criteria

A: The sheets were not blocked at all.

B: The sheets were slightly blocked, but could be easily separated without problems.

C: The sheets were blocked, and cannot be easily separated or were partly broken when separated.

<Transfer Property Evaluation Method>

Whether the evaluation samples were transferred in the printer without problems in the image printing process was evaluated based on the following evaluation criteria.

Evaluation Criteria

A: The transfer was carried out without problems.

B: The transfer property was slightly inferior, resulting in an uneven gray image C: The sample was largely displaced in the transfer disadvantageously. .

TABLE 1

| | | | | | | | | | | |
|---|---|---|---|---|---|---|---|---|---|---|
| Ink-jet recording sheet | Ink-jet recording sheet | A | B | C | D | E | F | G | A | B |
| | Composition of water-absorbent layer coating liquid | A | B | C | A | D | E | — | A | B |
| | Back-surface water-absorbent polymer | Poly alkylene oxide-based polymer | HPC | Poly acrylate-based polymer | Poly alkylene oxide-based polymer | PVA | Poly alkylene oxide-based polymer | — | Poly alkylene oxide-based polymer | HPC |
| | Transfer amount of pure water ($g/m^2$) | 5 | 5 | 5 | 1 | 5 | 5 | — | 5 | 5 |
| | Dry mass of water-absorbent layer ($g/m^2$) | 2 | 2 | 2 | 0.4 | 2 | 2 | — | 2 | 2 |
| | Pigment (back surface) | Silica | Silica | Silica | Silica | Silica | — | — | Silica | Silica |
| Recording method | Pressure treatment | — | — | — | — | — | — | — | Treated | Treated |
| Evaluation | Hue change | B | B | B | C | C | A | D | A | A |
| | Blocking | A | A | B | A | A | C | A | A | A |
| | Transfer property | A | A | A | A | A | C | B | A | A |
| Note | | Present invention | Present invention | Present invention | Present invention | Present invention | Comparative | Comparative | Present invention | Present invention |

HPC: Hydroxypropyl celulose

As is clear from Table 1, the comparative ink-jet recording sheets were poor in the hue change, the blocking, or the transfer property, while the ink-jet recording sheets of the invention were excellent in the properties. Particularly the samples obtained by subjecting the printed ink-jet recording sheets A and B to the pressure treatment were superior.

What is claimed is:

1. An inkjet recording medium comprising a non-absorbent support;

an ink-receiving layer containing a first inorganic pigment and a binder, disposed on one surface of the non-absorbent support; and a water-absorbent layer containing a water-absorbent polymer and a second inorganic pigment, disposed on the other surface of the non-absorbent support, opposite to the one surface provided with the ink-receiving layer, wherein the water-absorbent layer has an absorption capacity of 2 to 15 $g/m^2$, the amount of the water-absorbent polymer applied to the water-absorbent layer is 0.5 to 20 $g/m^2$, and the ratio of the second inorganic pigment to the water-absorbent polymer is 10% to 70% by mass.

2. An ink jet recording medium according to claim 1, wherein the water-absorbent polymer is a polyacrylate polymer, a polyalkylene oxide polymer, a starch, or a water-soluble cellulose derivative.

3. An ink-jet recording medium according to claim 1, wherein the inorganic pigment comprises silicon dioxide.

4. An ink-jet recording medium according to claim 1, wherein the first inorganic pigment comprises fine silica particles.

5. An ink-jet recording medium according to claim 1, wherein the binder contained in the ink-receiving layer comprises a polyvinyl alcohol.

6. An ink-jet recording medium according to claim 1, wherein the non-absorbent support is a transparent or opaque support.

7. An ink-jet recording medium according to claim 1, wherein the non-absorbent support comprises a resin-coated paper.

8. A recording method comprising subjecting a stack of a plurality of ink-jet recording media according to claim 1 to a pressure treatment after printing.

* * * * *